US009644645B2

(12) United States Patent
Ozzello

(10) Patent No.: US 9,644,645 B2
(45) Date of Patent: May 9, 2017

(54) SERVOVALVE HAVING TWO STAGES AND A PILOT STAGE ADAPTED TO SUCH A SERVOVALVE

(71) Applicant: ZODIAC HYDRAULICS, Chateaudun (FR)

(72) Inventor: Guylain Ozzello, La Chapelle Encherie (FR)

(73) Assignee: ZODIAC HYDRAULICS, Chateaudun (FR)

( * ) Notice: Subject to any disclaimer, the term of this patent is extended or adjusted under 35 U.S.C. 154(b) by 119 days.

(21) Appl. No.: 14/351,390

(22) PCT Filed: Oct. 8, 2012

(86) PCT No.: PCT/EP2012/069860

§ 371 (c)(1),
(2) Date: Apr. 11, 2014

(87) PCT Pub. No.: WO2013/053668

PCT Pub. Date: Apr. 18, 2013

(65) Prior Publication Data

US 2014/0251447 A1 Sep. 11, 2014

(30) Foreign Application Priority Data

Oct. 12, 2011 (FR) ..... 11 59209

(51) Int. Cl.

| | |
|---|---|
| ***F15B 13/043*** | (2006.01) |
| ***F15B 9/06*** | (2006.01) |
| ***F15B 9/07*** | (2006.01) |
| ***F15B 13/16*** | (2006.01) |

(52) U.S. Cl.
CPC ..... *F15B 13/043* (2013.01); *F15B 9/06* (2013.01); *F15B 9/07* (2013.01); *F15B 13/0436* (2013.01); *F15B 13/16* (2013.01); *Y10T 137/2409* (2015.04)

(58) Field of Classification Search
CPC .... F15B 13/043; F15B 13/0436; F15B 13/16; F15B 9/06; F15B 9/07; Y10T 137/2409
See application file for complete search history.

(56) References Cited

U.S. PATENT DOCUMENTS 3,554,211 A * 1/1971 Bernstein ..... F15B 13/0438 137/625.62
3,814,131 A 6/1974 Takahashi et al.
4,046,059 A * 9/1977 Leonard ..... F15B 9/08 137/625.63

(Continued)

FOREIGN PATENT DOCUMENTS

GB 1 222 094 A 2/1971

OTHER PUBLICATIONS

International Search Report for PCT/EP2012/069860 dated Nov. 7, 2012.

*Primary Examiner* — Kevin Murphy
*Assistant Examiner* — Daphne M Barry
(74) *Attorney, Agent, or Firm* — Sughrue Mion, PLLC

(57) ABSTRACT

A hydraulic servovalve having two stages and feedback members in which the movable power distribution member has clamp means for clamping the feedback member, while allowing a clamped portion of the feedback member at least one freedom of movement relative to the movable distribution member.

15 Claims, 4 Drawing Sheets

(56) References Cited

U.S. PATENT DOCUMENTS

| | | | | |
|---|---|---|---|---|
| 4,152,971 | A * | 5/1979 | Leonard | F15B 9/08 137/625.6 |
| 4,285,358 | A | 8/1981 | Haydt | |
| 4,335,645 | A * | 6/1982 | Leonard | F15B 9/08 137/625.62 |
| 8,967,179 | B2 * | 3/2015 | Ozzello | F15B 13/0436 137/625.61 |
| 2015/0176720 | A1 * | 6/2015 | de la Chevasnerie | F16K 31/124 251/30.01 |

* cited by examiner

SERVOVALVE HAVING TWO STAGES AND A PILOT STAGE ADAPTED TO SUCH A SERVOVALVE

CROSS REFERENCE TO RELATED APPLICATIONS

This application is a National Stage of International Application No. PCT/EP2012/069860, filed on Oct. 8, 2012, which claims priority from French Patent Application No. 11 59209, filed on Oct. 12, 2011, the contents of all of which are incorporated herein by reference in their entirety.

FIELD OF THE INVENTION

The invention relates to a servovalve pilot stage capable of acting as a first stage in a two-stage servovalve.

STATE OF THE ART

A conventional servovalve is constituted by a pilot stage piloting a movable power distribution member of a power stage. The function of the power stage is to deliver a pressure or a flow rate proportional to an instruction transmitted to the pilot stage.

The pilot stage has two hydraulic elements, namely a hydraulic emitter (nozzle or ejector) and a hydraulic receiver (fixed receiver, deflector, or flapper) such that modifying their relative position generates pressure differences that are used for finely moving a movable power distribution member of the power stage of the servovalve. This movable power distribution member slides in a cylindrical sleeve or cylinder installed in the body of the servovalve. In general, the position of the hydraulic emitter or receiver is controlled by a torque motor that moves one of the hydraulic elements of the pilot stage relative to the other. The movement of the movable power distribution member in its cylinder then puts into communication a set of drilled channels and slots that are arranged in such a manner as to enable a power or a flow rate to be delivered that is proportional to the movement of said movable power distribution member.

Such servovalves have a mechanical connection between the rotor of the torque motor and the movable power distribution member, which connection is made with the help of a feedback member. The feedback member is generally connected to the movable power distribution member via its middle and is also connected to the hydraulic element associated with the rotor via the rotor. The feedback member servocontrols the position of the movable power distribution member of the rotor of the servovalve and generates a torque on the torque motor that is subtracted from the control action.

In most circumstances, the feedback member comprises a flexible blade or rod operationally connected to the rotor at one of its ends and carrying a ball at its other end. The ball of the feedback member interacts with a groove or a bore situated in the center of the movable power distribution member. Operating clearance allows the ball both to act as a ball joint and to slide in the groove, thereby enabling the movable power distribution member to move in a direction that extends transversely to the axis of the feedback blade or rod. This connection allows relative sliding between the two ends and therefore gives rise to a small amount of parasitic friction between the movable power distribution member and the cylinder carrying it, enabling the servovalve to provide performance in terms of hysteresis and resolution that is acceptable, given the requirements of the users of such equipment.

Each time the movable power distribution member moves, the ball bears against and rolls on one or the other of the faces of the groove that contains it. Repeated movements of the movable power member acting on the interface between the ball and the groove that contains it, give rise to wear in this connection, which thus increases the clearance between the movable power distribution member and the ball of the feedback member. This wear gives rise to an increase in the clearance between the spool and the feedback member, which increase disturbs the servocontrol of the servovalve. This disturbance gives rise to numerous servovalves being returned as faulty. Reducing this friction wear would thus make it possible to make such equipment more reliable and to increase its lifetime.

Solutions for mitigating this weakness may consist in selecting materials that are harder or in performing local surface treatments that serve to reduce the wear caused by friction. Since servovalves are compact pieces of equipment using parts that are of small dimensions, such solutions are found in practice to be difficult to implement.

Rigid connection devices are also known for connecting the feedback member to the movable power distribution member by clamping the feedback member. In such devices, presser screws mounted along a longitudinal axis in the movable power distribution member serve to clamp against the feedback member, thereby eliminating any clearance between those two elements. A major drawback of that solution lies in the radial forces that are generated by the connection and that give rise to high levels of friction between the movable power distribution member and the cylinder in which it slides. Such friction quickly degrades the sliding surfaces between the movable power distribution member and the cylinder, thereby compromising the reliability and the lifetime of the servovalve. Such friction has a major impact on the sensitivity of the servovalve and in particular degrades its hysteresis, which in extreme circumstances can go so far as to jam the valve completely.

Document U.S. Pat. No. 3,814,131 describes fitting a conical endpiece to the end of the feedback member, which endpiece is slidably received in a bushing having a complementary conical hole. The bushing extends inside the movable power distribution member while being secured thereto by springs (specifically spring blades) enabling the bushing to turn about an axis perpendicular to the longitudinal axis of the movable power distribution member. Thus, during a movement of the movable power distribution member, the conical endpiece moves inside the bushing, which itself is subjected to rotation made possible by the flexibility of the blade. That solution satisfies the problem of wear in the connection between the feedback member and the movable power distribution member in part only, since it gives rise to friction between the bushing of the flexible blade and the conical endpiece of the feedback member.

OBJECT OF THE INVENTION

An object of the invention is to reduce the wear generated by the relative movements of the feedback member and of the movable power distribution member in a servovalve while conserving characteristics in terms of resolution and hysteresis that are acceptable.

SUMMARY OF THE INVENTION

To this end, the invention provides a two-stage hydraulic servovalve comprising:

a power stage including a movable power distribution member; and a pilot stage comprising a torque motor having a rotor connected to a hydraulic fluid emitter or deflector, and a deformable feedback member operationally connected to the rotor and to the movable power distribution member in order to establish a mechanical connection between them. According to the invention, the movable power distribution member has clamp means for clamping the feedback member, which means are arranged to allow a clamped portion of the feedback member to move relative to the movable power distribution member at least along a direction extending transversely to a clamping force generated by the clamp means.

The connection made by clamping between the movable power member and the feedback member thus takes place without clearance and reduces the wear at the junction between those two parts.

In a particularly advantageous embodiment, the clamp means are shaped to allow at least one freedom of movement for a clamped portion of the feedback member relative to the movable power distribution member, at least in a direction that extends transversely to the clamping force generated by the clamp means. This type of clamping makes it possible for the connection between the movable power distribution member and the feedback member to limit the generation of forces that are harmful to the movement of the movable power distribution member in its cylinder. These movements are preferably obtained by using slender metal rods.

Other characteristics and advantages of the invention appear on reading the following description of particular, non-limiting embodiments of the invention.

BRIEF DESCRIPTION OF THE DRAWINGS

Reference is made to the accompanying drawings, in which.

DETAILED DESCRIPTION OF AT LEAST ONE EMBODIMENT OF THE INVENTION

Figure 1:
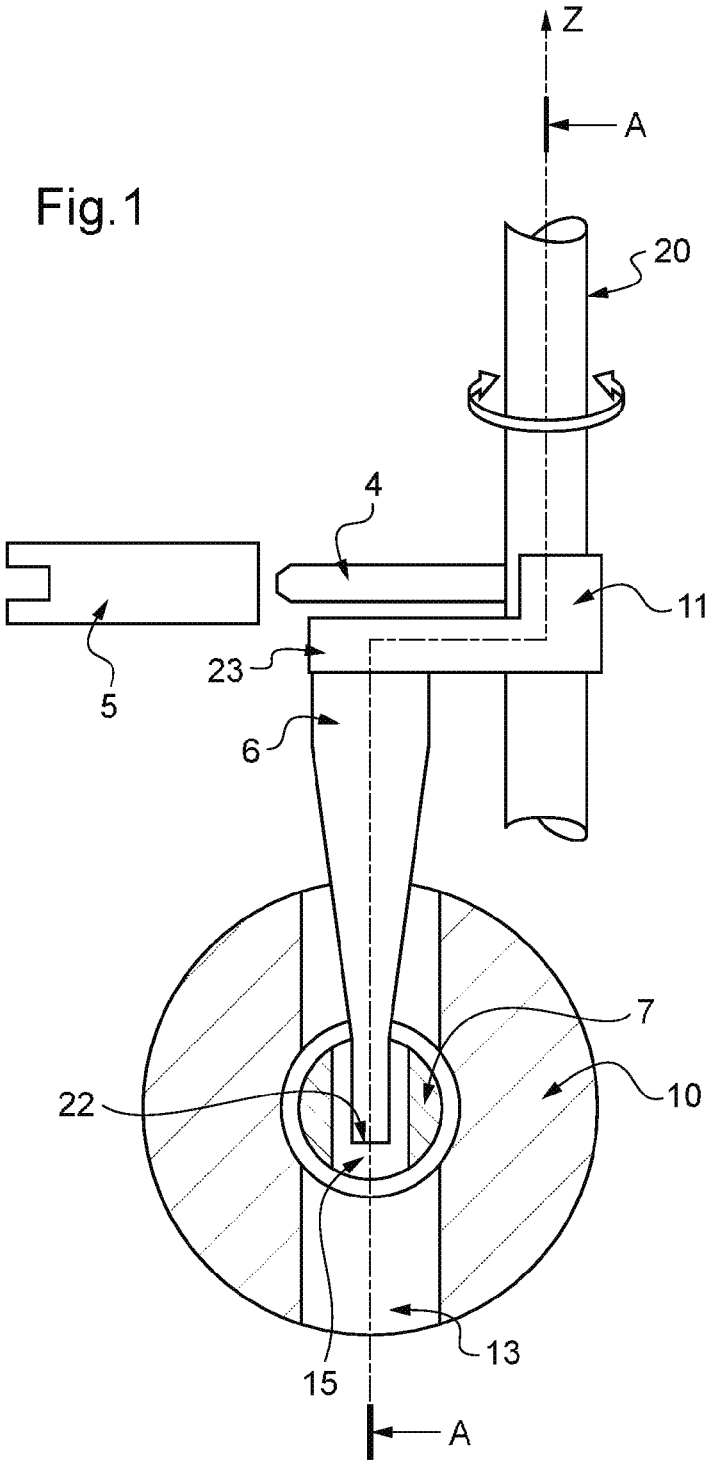
FIG. 1 is a section view on a plane normal to the movement axis of the movable power distribution member of a servovalve of the invention.
Figure 2:
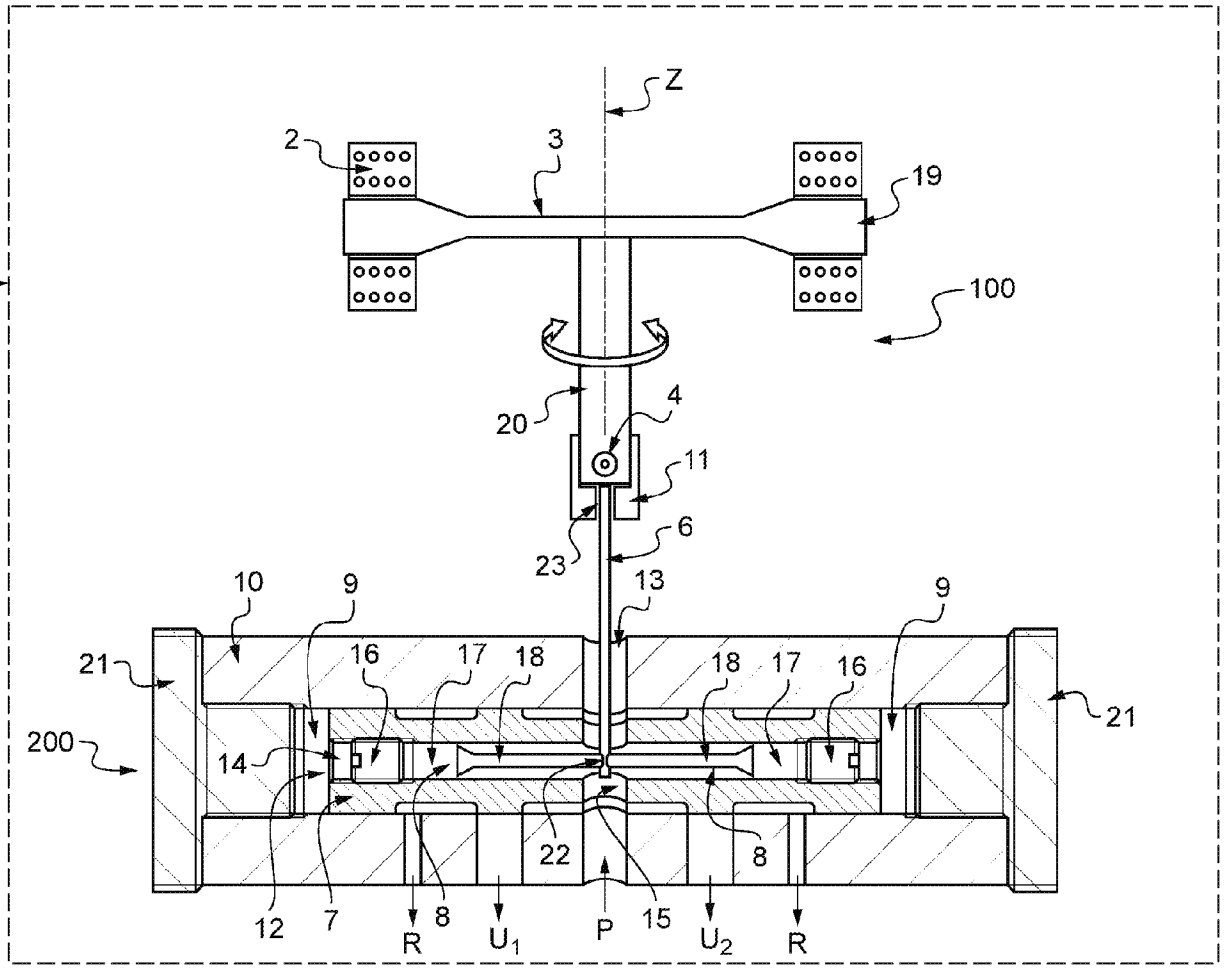
FIG. 2 is a section view on a plane marked by a broken line A-A in FIG. 1.
Figure 3:
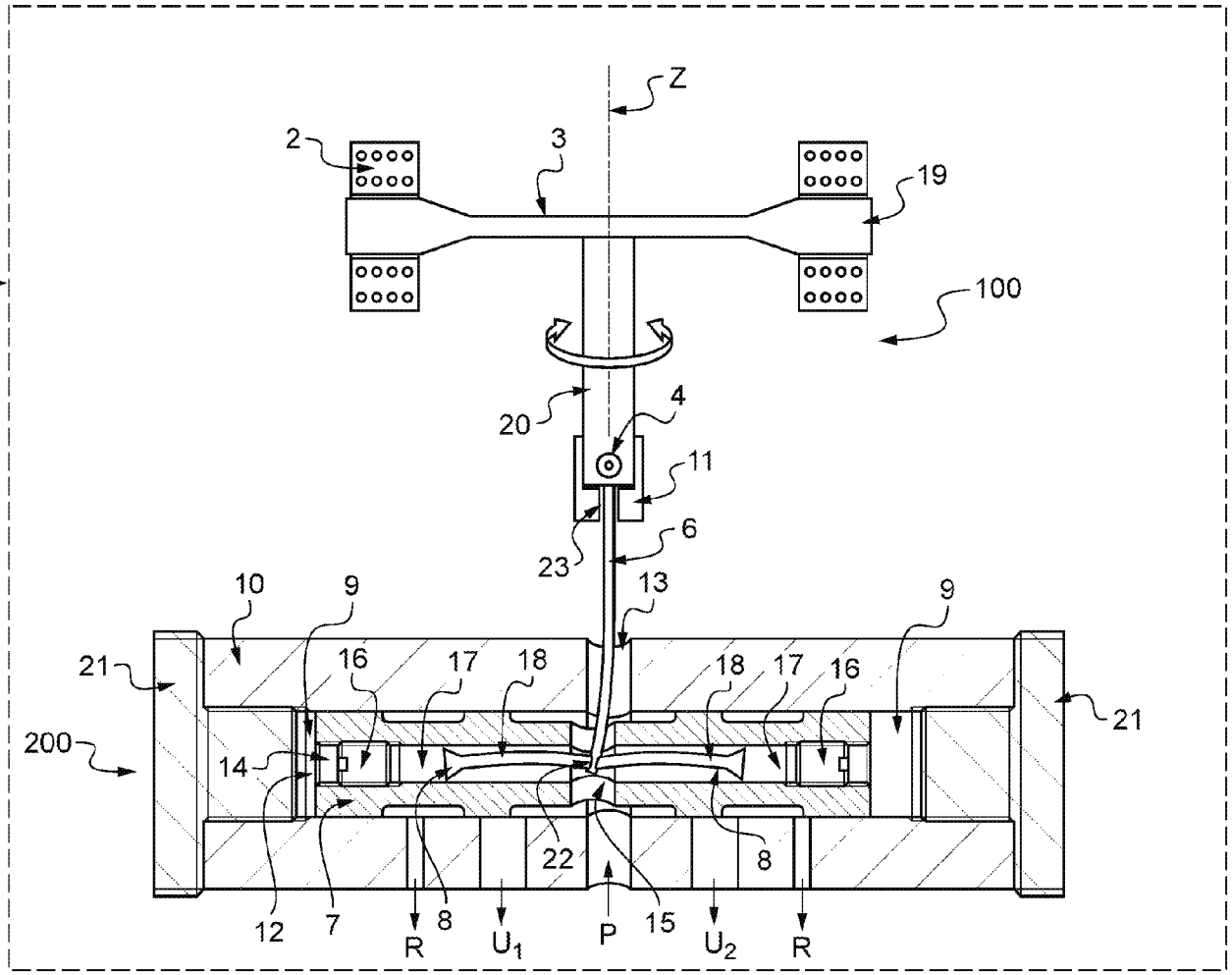
FIG. 3 is a view analogous to that of FIG. 2, showing the power stage during a movement of the movable power distribution member of the servovalve.

With reference to FIGS. 1 and 2, the servovalve given overall reference 1 comprises a pilot stage 100 and a power stage 200. The pilot stage 100 has a torque motor comprising TM a stator 2 and a rotor 3. The stator 2 has a stage surrounding the rotor 3, which turns about the axis Z. The rotor 3 has two main elements:

a magnetic flapper 19 subjected to the magnetic field developed by the stator 2 and movable relative to the body of the servovalve 1; and a column 20 secured to the magnetic flapper 19 and extending along the axis Z, projecting from the stator and penetrating into the inside of the servovalve body.

The column 20 carries a fluid ejector 4 that faces a stationary receiver 5. The column 20 is fed with fluid and the fluid ejector 4 sends a jet of hydraulic fluid towards the stationary receiver 5 along an angular orientation that is a function of the movement of the rotor 3. The column 20 is coupled to a resilient return member (not shown) urging it towards an equilibrium position in which the ejector 4 is substantially facing the center of the receiver 5.

The power stage 200 comprises a cylinder 10 fastened in leaktight manner to the frame of the servovalve 1. This cylinder has an axial bore 12 machined along its center and having a spool 7 slidably mounted therein. The cylinder 10 has drilled channels and slots communicating with a hydraulic power feed port P, outlet ports U1 and U2, and a return port R of the servovalve. The cylinder 10 is pierced by a second bore 13 that is radial and passes through its middle. Two plugs 21 screwed onto the body of the servovalve 1 at opposite ends of the cylinder 10 participate in holding the cylinder in the body of the servovalve 1 and provide sealing between the bore 12 and the outside.

The receiver 5 is in fluid flow connection with pilot chambers 9 situated at opposite ends of the spool 7; as a result an angular movement of the ejector 4 facing the receiver 5 gives rise to a pressure difference in the pilot chambers 9, thereby imparting a movement force on the spool 7.

The spool 7 is cylindrical in shape and pierced by two bores comprising an axial first bore 14 and a radial second bore 15 made substantially through its middle.

A feedback blade 6 mechanically connected to the spool 7 and secured to the column 20 passes through the radial bore 13 in the cylinder 10 and the radial bore 15 in the spool 7 so that one end of the feedback blade 6 extends inside the axial bore 12 of the spool 7.

In this example, the feedback blade 6 is substantially triangular in shape and has a base 23 that is connected to a bushing 11 that is shrink-fitted on the column 20. The tip of the blade 6 forms an end 22 that extends through the radial bores 13 and 15 of the cylinder 10 and of the spool 7.

In the invention, the end 22 of the feedback blade 6 is clamped by clamp means 8 secured to the spool 7. In this example, the clamp means 8 comprise presser screws 16 screwed into the spool 7 in tapped lengths thereof that are coaxial with the bore 12. The presser screws 16 push against clamp members 17 that are slidably mounted in the axial bore 12 and that carry metal rods 18, which rods are cantilevered out to clamp against the end 22 of the feedback blade 6.

The feedback blade 6 is clamped by screwing the presser screws 16 so that they exert a force on the clamp members 17, which in turn transmit this force to the rods 18. The ends of the rods 18 clamp against the feedback blade 6, thereby providing a connection between it and the spool 7.

Assembly operations preferably comprise the following succession of steps:

mounting the spool 7 in the cylinder 10 that is already held in place in the servovalve body 1;

mounting the pilot stage 100 on the servovalve body 1, the feedback blade 6 being inserted through the bores 13 and 15;

putting the clamp members 17 into place together with the presser screws 16 in the bore 14;

tightening the presser screws 16 onto the end 22 of the feedback blade 6; and installing and tightening the plugs 21.

Figure 4:
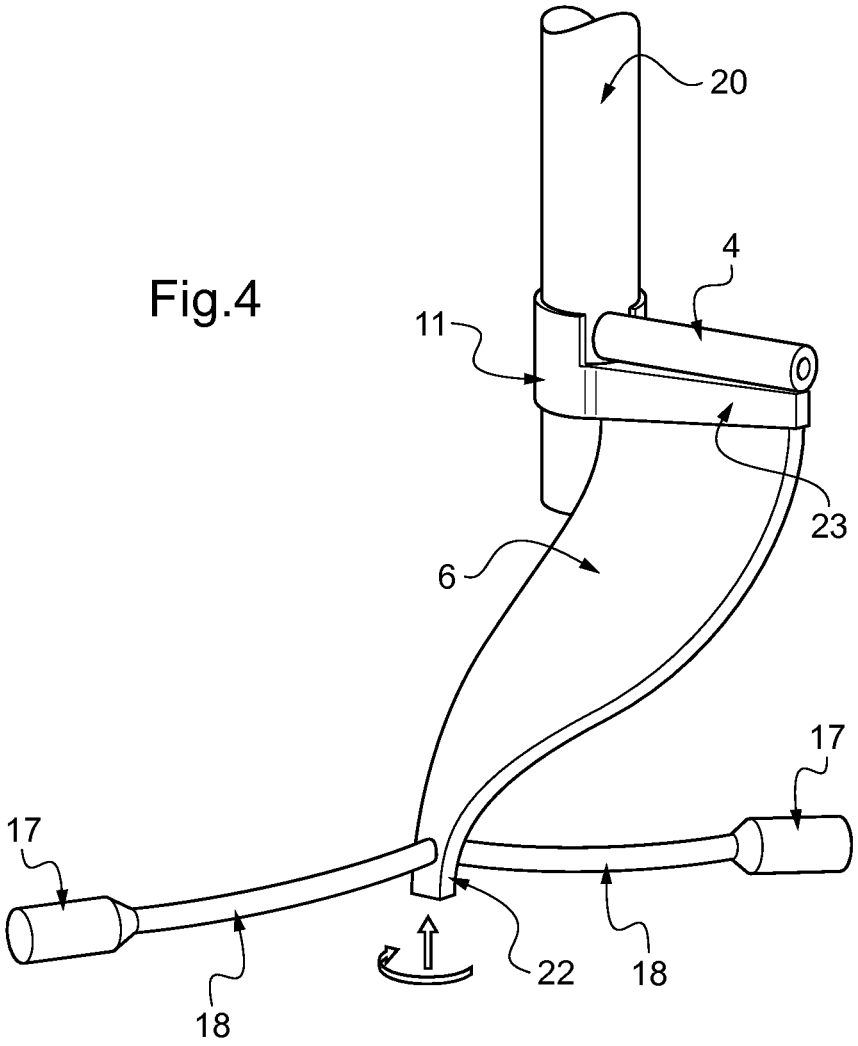
FIG. 4 is a fragmentary perspective view of the feedback member during a movement of the movable power distribution member of the servovalve.

There follows an explanation of the operation of the assembly. In response to a request from a user, an instruction in the form of an electric current is sent to the stator 2 of the torque motor TM. This instruction causes the rotor 3 to move angularly about the axis Z. The twisting force exerted by the torque motor on the column 20 via the rotor 3 modifies the relative position of the ejector 4 and the stationary receiver 5, leading to a pressure difference between the chambers 9 situated at opposite ends of the spool 7. The spool then moves by an amount that its substantially proportional to the electrical instruction received by the torque motor. The movement of the spool 7 in the cylinder 10 then puts a set of drilled channels and slots into communication, which channels and slots are arranged in such a manner as to deliver a pressure or a flow rate proportional to the movement of said power distribution member 7. The base 23 of the feedback blade 6 held firmly by the column 20 is then subjected to an angular movement in one direction while its clamped end is subjected to a movement of the spool 7 in an opposite direction, as shown in FIG. 4. The feedback blade 6 then exerts a resilient return force performing a servocontrol function between the spool 7 and the rotor 3 (via the column 20) by generating a torque on the rotor 3 that is subtracted from the control action.

The movement of the clamped end 22 of the feedback blade 6 along the travel axis of the spool 7 (which is parallel to the clamping force) subjects the feedback blade 6 to a bending force, and thus causes the clamped end to move in a direction normal to said axis, and also, in the example shown, causes said end to move angularly, as represented by arrows in FIG. 4. This movement is made possible by the flexibility of the clamp means 8 resulting from the flexibility of the metal rods 18, without any additional stresses being transmitted to the movable power distribution member.

Thus, the relative movement of the spool 7 and of the feedback blade 6 takes place without friction between these parts, thereby reducing their wear.

Naturally, the invention is not limited to the embodiments described but covers any variant coming within the ambit of the invention as defined by the claims.

In particular:

the clamp means 8 of the feedback member 6 may have a single presser screw 16, e.g. clamping the feedback member against a stationary portion;

the flexibility of the clamp means of the above-described feedback member may be provided by deformable members such as, for example: springs; polymer elements or elements based on latex; a hydraulic damper; or indeed Belleville washers;

the feedback member 6 may be connected to the rotor via the column 20 or by a mechanical connection with the ejector or the nozzle of the pilot stage;

although the bushing 11 connecting the feedback member to the column 20 is shrink-fitted thereon, the invention also applies to other fastening means such as welding or keying;

although the movable power member described is a spool 7, the invention also applies to a servovalve having other types of movable power member such as rotary valves, for example;

although the feedback member in this example is a feedback blade 6, the invention also applies to a servovalve fitted with other types of feedback member such as feedback rods, for example; and finally although the hydraulic emitter in the example is connected to the rotor of the motor via a column, the invention is naturally not limited to this configuration, and it applies to other types of servovalve in which the position of the hydraulic emitter relative to the receiver is determined for example by an eccentric or indeed by a connecting rod connected to the movable portion of the motor.

The invention claimed is:

1. A two-stage hydraulic servovalve comprising:

a power stage including a movable power distribution member; and a pilot stage comprising a torque motor having a rotor connected to a hydraulic fluid emitter or deflector, and a deformable feedback rod or blade operationally connected to the rotor and to the movable power distribution member in order to establish a mechanical connection between them, wherein the movable power distribution member has clamp means for clamping the feedback rod or blade, and the clamp means exerts a clamping force directly on the feedback rod or blade, and the clamp means are arranged to allow a clamped portion of the feedback rod or blade to move relative to the movable power distribution member at least along a direction extending transversely to a clamping force generated by the clamp means, and the clamp means are also arranged to allow a portion of the feedback rod or blade on which the clamping force is applied to slide relative to the movable power distribution member along a power stage main axis.

2. The servovalve according to claim 1, wherein the clamp means comprise at least one presser screw.

3. The servovalve according to claim 1, wherein the clamp means comprise two presser screws mounted in opposition.

4. The servovalve according to claim 1, wherein the clamp means comprise cantilevered-out metal rods having ends that clamp against the feedback rod or blade, thereby allowing the clamped portion of the feedback rod or blade to move under the effect of the metal rods bending.

5. The servovalve according to claim 1, wherein the movable power distribution member is substantially cylindrical and the clamp means are installed in a bore made in the movable power distribution member along an axis of revolution of said movable power distribution member.

6. The servovalve according to claim 1, wherein the power distribution member is slidable along the power stage main axis and where the clamping means applies the clamping force in a direction co-axial with the main axis.

7. The servovalve according to claim 1, wherein the power distribution member is slidable along the power stage main axis and where the clamping means comprises a presser screw that moves in a direction co-axial with the main axis so as to apply the clamping force in the direction co-axial with the main axis.

8. A two-stage hydraulic servovalve comprising:

a power stage including a movable power distribution member movable in an axial direction of the power stage; and a pilot stage comprising a torque motor having a rotor connected to a hydraulic fluid emitter or deflector, and a deformable feedback rod or blade operationally connected to the rotor and to the movable power distribution member in order to establish a mechanical connection between them;

wherein the movable power distribution member has a clamp that clamps the feedback rod or blade, while allowing a clamped portion of the feedback rod or blade to move relative to the movable power distribution member at least along a direction extending transversely to a clamping force generated by the clamp; and wherein the clamp applies the clamping force directly on the feedback rod or blade in the axial direction of the power stage, and the clamp means are also arranged to allow a portion of the feedback rod or blade on which the clamping force is applied to slide relative to the movable power distribution member in the axial direction of the power stage.

9. The servovalve according to claim 8, the clamp is a presser screw that moves in the axial direction of the power stage.

10. The servovalve according to claim 9, wherein the presser screw includes a cantilevered rod with a free end directly abutting and clamping the feedback rod or blade.

11. The servovalve according to claim 8, wherein the clamp comprises a rod with a free end directly abutting and clamping the feedback rod or blade.

12. The servovalve according to claim 8, wherein the clamp comprises two presser screws, each presser screw moves in the axial direction of the power stage but in opposite directions to one another, each presser screw comprising a rod with a free end directly engaged to and clamping the feedback rod or blade with opposing forces.

13. A two-stage hydraulic servovalve comprising:

a power stage including a movable power distribution member movable along a power stage main axis; and a pilot stage comprising a torque motor having a rotor connected to a hydraulic fluid emitter or deflector, and an elongated deformable feedback member operationally connected to the rotor and to the movable power distribution member in order to establish a mechanical connection between them;

wherein the movable power distribution member has two opposing rod members that clamp one end portion of the elongated deformable feedback member, wherein the clamped end portion of the elongated deformable feedback member can move relative to the movable power distribution member at least along a direction extending transversely to a clamping force generated by the opposing rod members; and wherein the opposing rod members apply the clamping force in a direction co-axial with or parallel to the power stage main axis.

14. The two-stage hydraulic servovalve according to claim 13, wherein at least one of the opposing rod members is adjustable via a presser screw that presses on at least one of the opposing rod members.

15. The two-stage hydraulic servovalve according to claim 13, wherein the rod members are configured to flex in combination with flexure of the elongated deformable feedback member.

* * * * *